US010705475B2

(12) United States Patent
Abramsohn et al.

(10) Patent No.: US 10,705,475 B2
(45) Date of Patent: Jul. 7, 2020

(54) PHOTO-CONDUCTOR DRUM WITH PROTECTIVE LAYER OF MATERIAL

(71) Applicant: Hewlett-Packard Development Company, L.P., Houston, TX (US)

(72) Inventors: Dennis Alan Abramsohn, Boise, ID (US); Roberta Gayle Fothergill, Boise, ID (US); Brent L Meyer, Boise, ID (US); Jeff Luke, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/097,518

(22) PCT Filed: Jul. 20, 2016

(86) PCT No.: PCT/US2016/043098

§ 371 (c)(1),
(2) Date: Oct. 29, 2018

(87) PCT Pub. No.: WO2018/017074

PCT Pub. Date: Jan. 25, 2018

(65) Prior Publication Data

US 2019/0129350 A1 May 2, 2019

(51) Int. Cl.
*G03G 15/00* (2006.01)
*G03G 5/147* (2006.01)

(52) U.S. Cl.
CPC ..... *G03G 15/75* (2013.01); *G03G 5/147* (2013.01)

(58) Field of Classification Search
CPC ..... G03G 15/75; G03G 5/147
See application file for complete search history.

(56) References Cited

U.S. PATENT DOCUMENTS

| | | | | |
|---|---|---|---|---|
| 3,561,356 | A * | 2/1971 | Rarey | B41M 1/125 101/129 |
| 5,059,502 | A | 10/1991 | Kojima et al. | |
| 7,426,357 | B2 | 9/2008 | Moti | |
| 8,977,173 | B2 | 3/2015 | Matsubara et al. | |
| 10,114,336 | B2 * | 10/2018 | Shimizu | G03G 15/751 |
| 2010/0196054 | A1 * | 8/2010 | Masui | G03G 21/1832 399/234 |
| 2010/0236712 | A1 | 9/2010 | Basgil et al. | |
| 2010/0316420 | A1 * | 12/2010 | Mori | G03G 15/162 399/302 |
| 2011/0020016 | A1 | 1/2011 | Takahashi | |

(Continued)

FOREIGN PATENT DOCUMENTS

| | | | |
|---|---|---|---|
| JP | 2000242018 | A | 9/2000 |
| JP | 2001235971 | A | 8/2001 |

(Continued)

OTHER PUBLICATIONS

Webpage ~ Labels & Labeling ~ Precise Graphic launches rotary hot-foil stamping cylinder, Sep. 6, 2013 ~ 7 pages.

*Primary Examiner* — Susan S Lee
(74) *Attorney, Agent, or Firm* — Fabian VanCott

(57) ABSTRACT

A photo-conductor drum includes: a cylindrical surface to receive a charge pattern corresponding to an image to be printed; and a protective layer of material coating at least a portion of the cylindrical surface to protect the cylindrical surface from damage prior to installation of the drum in a printing device.

18 Claims, 8 Drawing Sheets

(56) References Cited

U.S. PATENT DOCUMENTS

| | | | | |
|---|---|---|---|---|
| 2011/0129270 | A1* | 6/2011 | Seo | G03G 21/0011 399/346 |
| 2011/0217651 | A1* | 9/2011 | Hayata | G03G 15/00 430/119.86 |
| 2011/0223527 | A1* | 9/2011 | Iio | G03G 8/00 430/105 |
| 2012/0195662 | A1 | 8/2012 | Hasegawa | |
| 2013/0259494 | A1* | 10/2013 | Hamaya | G03G 21/1832 399/9 |
| 2016/0139518 | A1* | 5/2016 | Prizant | G03G 5/147 399/346 |
| 2017/0329278 | A1* | 11/2017 | Matsumoto | G03G 21/1814 |

FOREIGN PATENT DOCUMENTS

| | | | | | |
|---|---|---|---|---|---|
| JP | 2004126002 | A | * | 4/2004 | |
| JP | 2010175925 | A | * | 8/2010 | G03G 21/1832 |
| JP | 2017191163 | A | * | 10/2017 | G03G 21/1842 |

* cited by examiner

PHOTO-CONDUCTOR DRUM WITH PROTECTIVE LAYER OF MATERIAL

BACKGROUND

Electrophotographic printers are widely used to produce hardcopy documents from electronic data. Laser printers are an example. In an electrophotographic printer, a pattern of electric charges is formed corresponding to the image to be printed. Charged toner is then attracted to the image pattern to develop the image. The image can then be transferred to a print medium, such as a sheet of paper. The toner can then be securely attached to the print medium and delivered as a hardcopy document.

BRIEF DESCRIPTION OF THE DRAWINGS

The accompanying drawings illustrate various implementations of the principles described herein and are a part of the specification. The illustrated implementations are merely examples and do not limit the scope of the claims.

Throughout the drawings, identical reference numbers designate similar, but not necessarily identical, elements.

DETAILED DESCRIPTION

Figure 1:
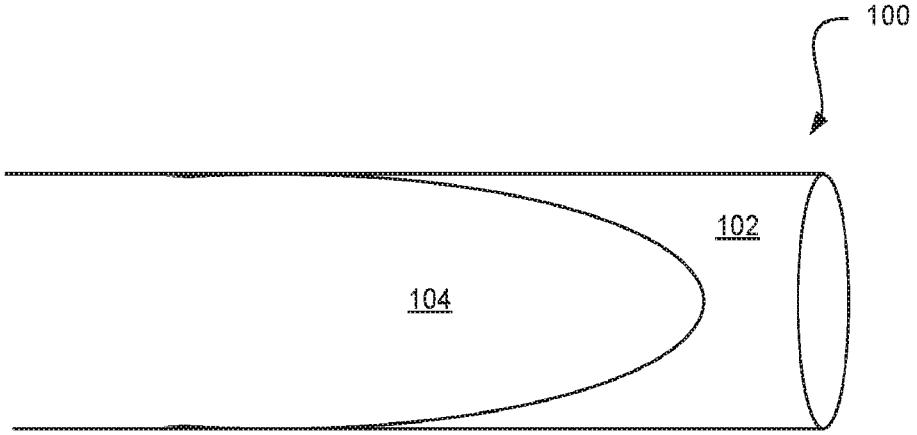
FIG. 1 is an illustration of an example of a photo-conductor drum, consistent with the disclosed implementations.

As noted above, electrophotographic printers are widely used to produce hardcopy documents from electronic data. Laser printers are an example. In an electrophotographic printer, a pattern of electric charges is formed corresponding to the image to be printed. Charged toner is then attracted to the image pattern to develop the image. The image can then be transferred to a print medium, such as a sheet of paper. The toner can then be securely attached to the print medium and delivered as a hardcopy document.

In a laser printer, for example, a uniform coverage of charges is initially formed on a photo-conductor drum. The laser is scanned over the surface of the cylindrical photo-conductor drum according to the image to be printed. Where the light of the laser illuminates the surface of the photo-conductor drum, a partially discharged area is formed. These charged and discharged areas together compose a pattern corresponding to the image to be printed.

Charged toner is then applied to the photo-conductor drum. The charged toner is then driven by electric fields in the latent electrostatic image to the discharged areas on the drum, thereby developing the image to be printed. The toner image can then be transferred to a print medium, such as a sheet of paper, to produce the desired hardcopy document.

In some examples, the surface and underlying layers are comprised of organic compounds and the drum is referred to as an organic photo-conductor (OPC) drum. Such OPC drums may have a green or blue-green colored surface.

The surface of the photo-conductor drum can be easily damaged. For example, if it is exposed to too much light or comes into contact with the natural or synthetic oils on a human hand, the photo-conductor drum can be impaired. A drum damaged in this way may produce degraded printed images of lower quality for many print cycles.

Also, over time, a photo-conductor drum will wear out and cease to be able to form and hold a charge pattern as described above. When this occurs, the photo-conductor drum is typically replaced with another. Thus, the photo-conductor drum is considered one of the consumables, such as toner cartridges, that are needed periodically by an electrophotographic printer. In many printers, a replacement photo-conductor drum is incorporated into a cartridge that is easily removed and replaced in the printing device. This OPC cartridge may itself also contain toner and other components of the electrophotographic print process.

Because new photo-conductor drums are installed periodically, there is an opportunity for the surface of the drum to be touched and damaged by the person installing it. Consequently, some protective measure to prevent damage to the drum in the event it is touched would be helpful. Also, the person installing the new photo-conductor drum could be warned not to touch the surface that will subsequently be used to form charge patterns and developed images.

Accordingly, the present specification describes, in one example, a photo-conductor drum that includes: a cylindrical surface to receive a charge pattern corresponding to an image to be printed; and a protective layer of material coating at least a portion of the cylindrical surface to protect the cylindrical surface from damage prior to installation of the drum in a printing device. The protective layer of material may also, in some examples, include an image formed of toner on the cylindrical surface of the drum, the image including a warning not to touch the cylindrical surface of the drum.

In another example, the present specification describes a method including: forming a photo-conductor drum with a cylindrical surface to receive a charge pattern corresponding to an image to be printed; forming a protective layer of material on the cylindrical surface to protect the surface from damage; and packaging the photo-conductor drum with the protective layer for distribution to an end-user. The end-user may be the person who installs the photo-conductor drum in a printing device.

In another example, the present specification describes a photo-conductor drum cartridge including: a photo-conductor drum having a cylindrical surface to receive a charge pattern corresponding to an image to be printed; a cartridge structure in which the photo-conductor drum is incorporated; and a protective layer of material coating at least a portion of the cylindrical surface to protect the cylindrical surface from damage prior to installation of the drum in a printing device, the protective layer comprising a warning image.

In yet another example, the present specification describes a method including: removing, from packaging, a photoconductor drum, where a surface of the drum is coated with a protective layer of material; and determining whether the surface of the photo-conductor drum contacted the packaging during shipping by noting material from the protective layer that has transferred during shipping from the surface of the drum to an interior of the packaging.

As used herein and in the following claims, the term "charge pattern" refers to a pattern of electrical charges. In the described subject matter, such a pattern may be formed on the surface of a photo-conductor drum, the pattern corresponding to an image to be printed in hardcopy form. A charge pattern may also be referred to as a latent electrostatic image.

As used herein and in the following claims, the term "textual warning" refers to a warning that is written using words in any language that composes words from constituent letters. A textual warning is distinct from an icon used in a warning in that the icon includes a pictogram or ideogram rather than a word or words.

As used herein and in the following claims, the term "replaceable cartridge" refers to a structure that includes at least one component of a printing device that is exhausted over time and must be replaced during the operating life of the larger printing device. The replaceable cartridge provides a structure configured to be readily inserted into and removed from the printing device to facilitate the replacement of consumable materials or exhaustible components within the printing device. Examples of replaceable cartridges including toner cartridges and photoconductor drum cartridges.

FIG. 1 is an illustration of an example of a photo-conductor drum, consistent with the disclosed implementations. As shown in FIG. 1, the photo-conductor drum (100) includes: a cylindrical surface (102) to receive a charge pattern corresponding to an image to be printed; and a protective layer of material (104) coating at least a portion of the cylindrical surface to protect the cylindrical surface from damage prior to installation of the drum in a printing device.

The material of the protective layer (104) is compatible with the printing process for which the drum (100) is used. For example, the protective layer (104) may be toner of the same or similar kind as that which would be used to form images on the drum during printing. The protective layer (104) is coated on at least a portion of the drum (100) prior to the drum being installed in the printing device. The protective layer (104) may cover the entire surface of the drum, just the printable area of the drum surface or some other portion of the drum surface.

With the protective layer (104) in place, if a user installing the drum inadvertently or unknowingly touches the drum, the surface (102) of the drum (100) will be protected from actual contact by the protective layer (104) and, thus, may be unaffected. For example, any oils on a user's hands that touch the drum (100) will be deposited on the protective layer (104) rather than on the drum surface (102). Similarly, some of the easily removable protective layer (104) may transfer to the user's hands and provide evidence of contact while still protecting the drum (100).

Additionally, as will be described further below, the protective layer (104) may be formed to include a warning image. Such a warning image is there to remind or warn a person installing the drum (100) that the surface (102) is not to be touched during installation.

Once the drum (100) is installed, the protective layer (104) is removed. Consequently, the layer (104) does not interfere with the subsequent operation of the drum (100) to form any desired image for printing.

Figure 2:
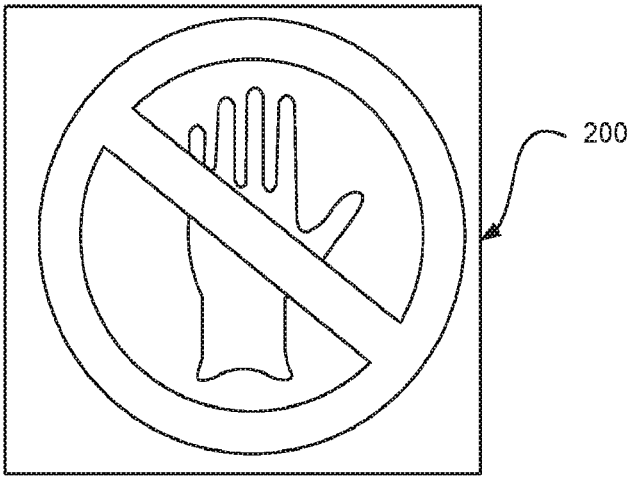
FIG. 2 is an illustration of an example of an icon for a warning on the surface of a photo-conductor drum, consistent with the disclosed implementations.

FIG. 2 is an illustration of an example of an icon (200) for a warning on the surface of a photo-conductor drum, consistent with the disclosed implementations. As shown in FIG. 2, a universally recognized symbol with a circle and crossbar over a human hand can be used to indicate that the surface of the drum is not to be touched with the human hand.

The warning image can be an icon, a textual warning, or be a combination of both. If textual, the warning image can be in any written language. The language for the warning may be chosen based on the location where the drum is expected to be sold or deployed. The warning image may also include warnings in multiple languages on the same drum.

The warning image can be formed at any location on the surface of the drum. The warning image may be repeated at different locations. A single warning image or a collection of varied warning images may be used to cover any fraction of the surface of the drum.

Figure 3:
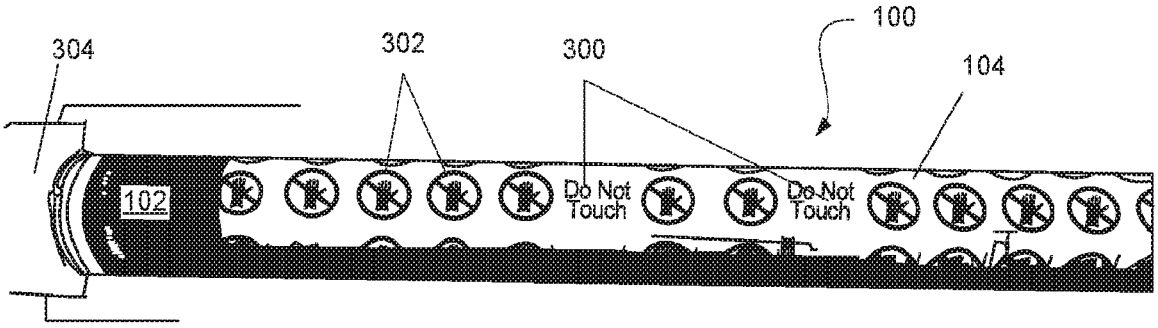
FIG. 3 is an illustration of an example of a photo-conductor drum bearing a warning on its surface, consistent with the disclosed implementations.

FIG. 3 is an illustration of a photo-conductor drum bearing a warning on its surface and installed in an electrophotographic printer, consistent with the disclosed implementations. As shown FIG. 3, the photo-conductor drum (100) may be part of a cartridge structure (304) configured to be readily installed in or removed from a printing device or printer. Even in cartridge form, however, at least portions of the drum (100) will be exposed and might be touched by an installer.

Consequently, as shown in FIG. 3, the surface (102) of the drum (100) bears a warning image as described above. In the example of FIG. 3, the warning image comprise both a repeated textual warning (300) and a repeated icon (302) warning a user or installer not to touch the surface (102) of the drum (100). The supporting structure of the printing device, the cartridge or packaging with the cartridge may also include an additional warning against touching the surface (102) of the drum (100).

Figure 4:
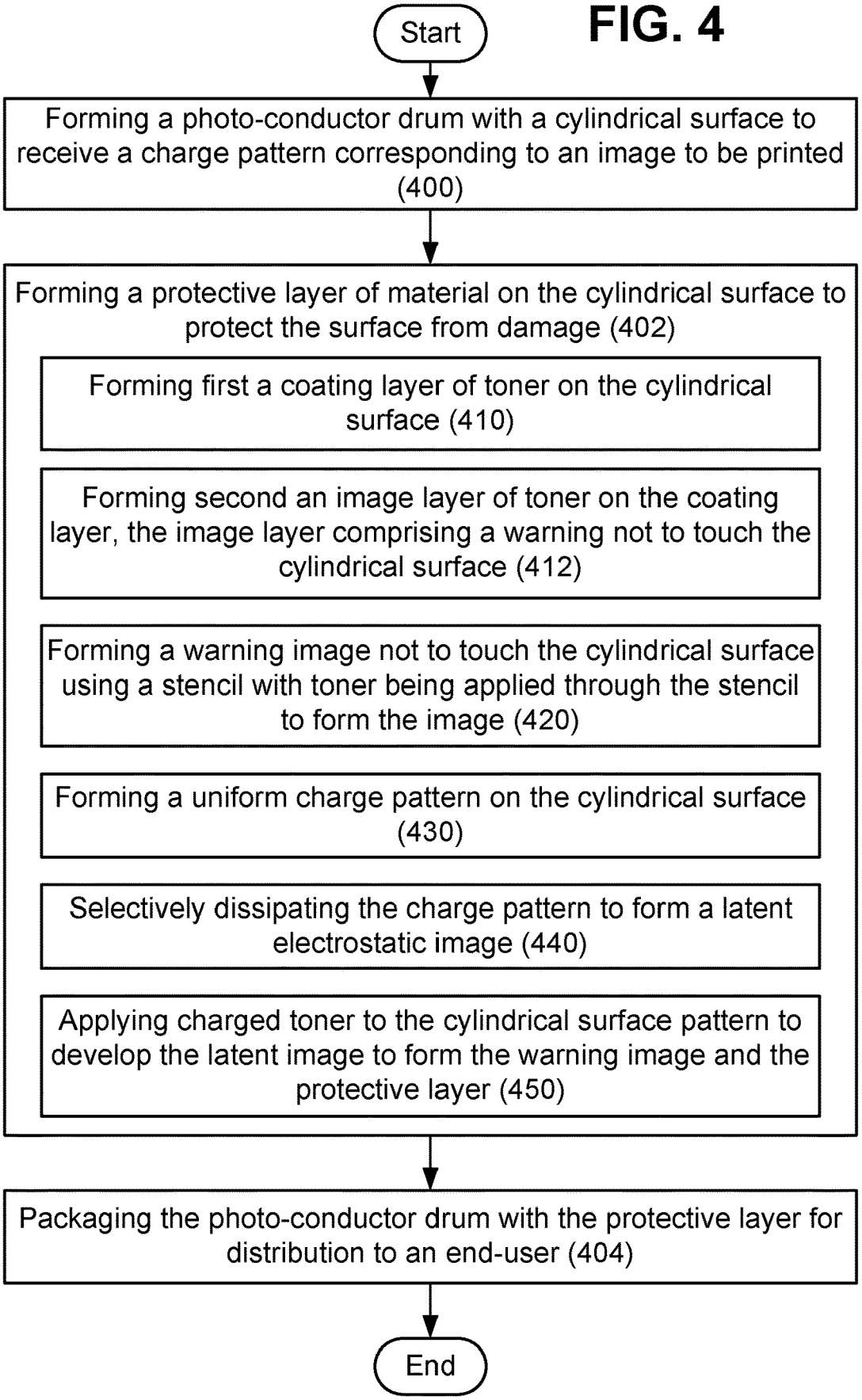
FIG. 4 is a flowchart of an example of a method of forming a photo-conductor drum, consistent with the disclosed implementations.

FIG. 4 is a flowchart of an example of a method of forming a photo-conductor drum, consistent with the disclosed implementations. As shown in FIG. 4, the method includes: forming (400) a photo-conductor drum with a cylindrical surface to receive a charge pattern corresponding to an image to be printed; forming (402) a protective layer of material on the cylindrical surface to protect the surface from damage; and packaging (404) the photo-conductor drum with the protective layer for distribution to an end-user.

As indicated above, the warning image may be a temporary image that is removed before the drum is used to print hardcopy documents. For example, the same electrophotographic process used to form a toner image on the drum that is to be transferred to a print medium can be used to form the desired warning image, using toner, on the surface of the drum as a part of the manufacturing process. This will be described in further detail below.

Figure 5:
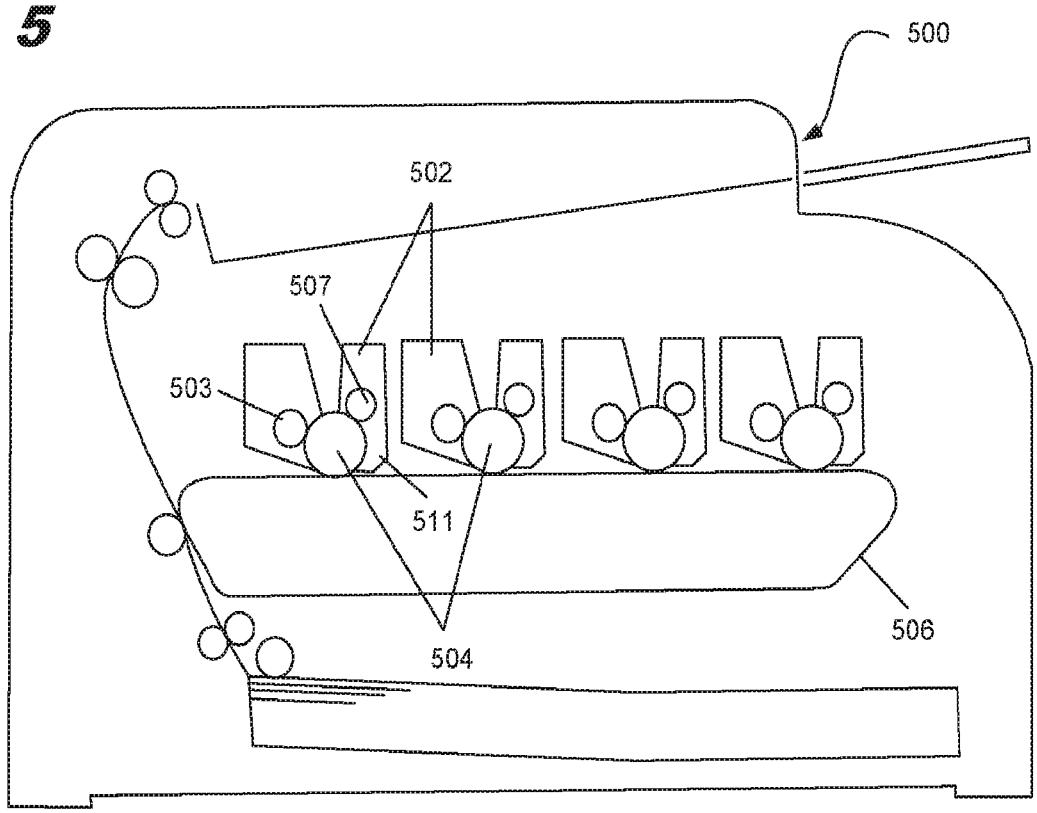
FIG. 5 is an illustration of components of an example electrophotographic printer, consistent with the disclosed implementations.

FIG. 5 is an illustration of components of an electrophotographic printer, consistent with the disclosed implementations. In the digital laser electrophotographic (EP) system (500) of FIG. 5, four cartridges (502) are used, each including a photo-conductor drum (504). Each drum (504) is used to form a different color plane of a desired image, for example, a CYMK color scheme. CYMK uses the primary colors of Cyan, Yellow, Magenta and Black. Each color plane is registered on a belt (506) to build up, collectively, the full color image. The image is then transferred to a print medium, such as paper.

Each cartridge includes a charging roller (507) to place, at 430 (FIG. 4), a uniform charge over the surface of the drum (504). A laser is then used to selectively dissipate, at 440 (FIG. 4), this charge to form a latent electrostatic image. A developing roller (503) is then used to apply, at 450 (FIG. 4), charged toner to develop the latent image.

A cleaning unit (511) serves to clean any residual toner from the drum (504) after the toner image has been transferred to the belt (506). When a cartridge (502) with a drum (504) bearing a protective layer is installed in the printing system (500), the cleaning unit (511) can be used to remove the protective layer prior to the drum (504) being used to print any hardcopies, in the same way that the cleaning unit (511) cleans the drum (504) during a regular printing cycle.

When a photo-conductor drum is being manufactured, a system operating on principles like those of FIG. 5 can be used to form the temporary warning on the drum. In other words, charging and laser imaging could be done in an external station as part of the final manufacturing process very similar to the imaging in a machine during printing. More specifically, the drum being manufactured is installed in an electrophotographic (EP) system. A uniform charge is applied to the surface of the drum with a charging unit. This uniform charge is the selectively dissipated by laser beams to form a charge pattern on the drum that corresponds to the warning not to touch that it is desired to have on the drum at installation. This charge pattern is then developed by a developer using ink or toner to render the warning image visible to a human being.

However, the drum is then removed from the system (500) without the warning image being transferred from the drum. In this way, the desired warning image is formed on the surface of the drum. The drum, bearing the warning image, is then packaged for sale and eventual deployment.

This could also be a process with multiple iterations to form a desired protective layer and warning image. For example, a similar charge and tone cycle, then a charge and tone cycle for a second time without cleaning or moving the drum in between could be employed in a manufacturing process on each drum before it was assembled in the cartridge or on the exposed surface once it had already been inserted in the cartridge but before final packaging.

Alternatively, the warning image on the drum could be formed by applying, at 420 (FIG. 4) a stencil to the drum surface and then applying toner through the openings in the stencil. In another alternative, a protective coating layer may include two layers: a first blanket layer formed, at 410 (FIG. 4), over the surface of the drum, with an image layer including a warning image formed, at 412 (FIG. 4), on top of the blanket layer. Any method of forming a protective layer, with or without a warning image, using toner or other printer compatible material may be used.

Figure 6:
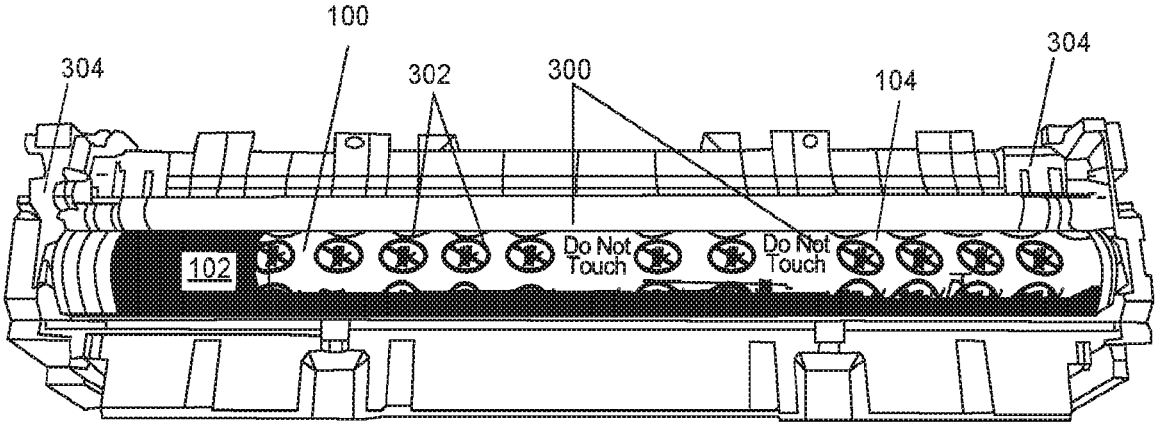
FIG. 6 is an illustration of an example of a photo-conductor drum cartridge, consistent with the disclosed implementations.

FIG. 6 is an illustration of an example of a photo-conductor drum cartridge, consistent with the disclosed implementations. As shown in FIG. 6, the drum (100) is incorporated in a cartridge (304), but remains at least partially exposed and subject to the risk of contact with the hands of an installer. Consequently, the protective layer (104), including a warning image (300, 302) is included on the surface (102) of the drum (100).

Figure 7:
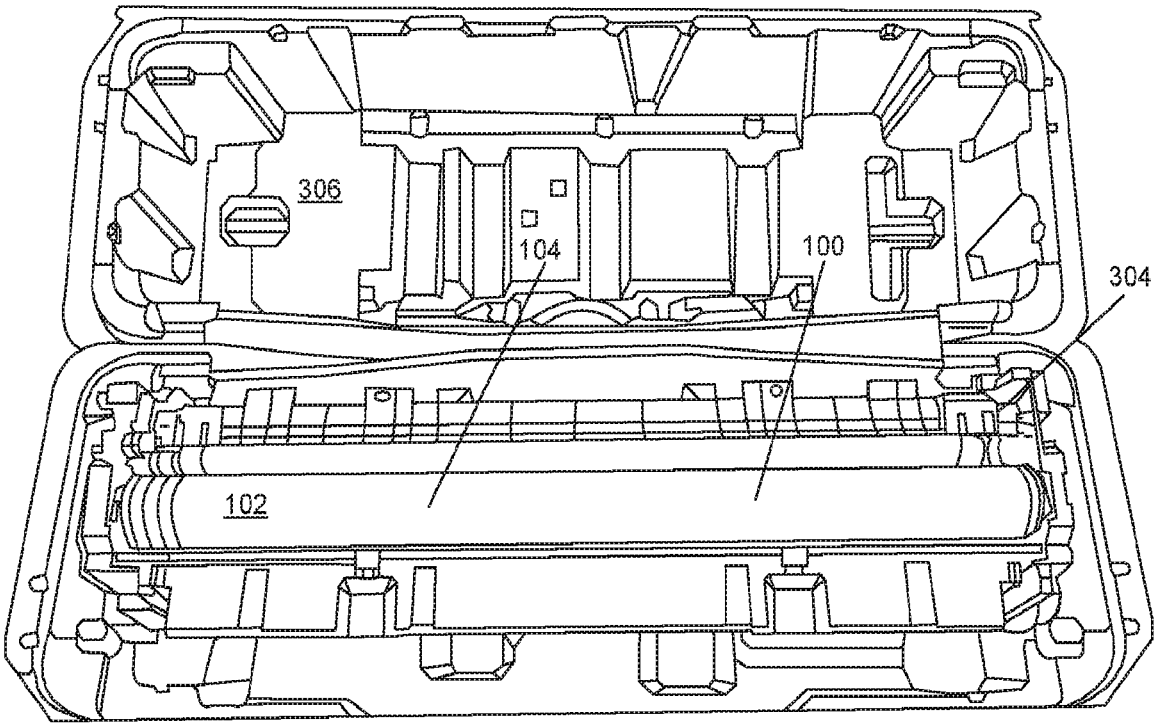
FIG. 7 is an illustration of an example of a photo-conductor drum cartridge with packaging, consistent with the disclosed implementations.

FIG. 7 is an illustration of an example of a photo-conductor drum cartridge with packaging, consistent with the disclosed implementations. As shown in FIG. 7, the cartridge (304), including the drum (100), may be packaged in a clamshell packaging for shipping. The packaging (306) includes ribs designed to support the cartridge (304) without contact to the drum (100).

However, during shipping, the packaging may be jostled, dropped or otherwise mishandled, causing the packaging (306) to contact the drum (100). As with other contact to the drum (100), described above, this may cause impairment of the drum (100) which is not apparent unless the drum (100) is deployed and used to print hardcopies on which resulting printing defects may be detected.

Consequently, the protective layer (104), described herein, provides two benefits. First, the protective layer (104) will receive any such contact from the packaging (306) that occurs during shipping. This may prevent the contact from impairing the drum (100). Second, if such contact does occur, material from the protective layer (104) will likely transfer from the drum (100) to the packaging at the point where the contact occurred. Consequently, when the cartridge (304) is unpacked, this transfer of material to the interior of the packaging (306) can be observed. This will indicate that the drum (100) may possibly have been impaired or damaged during shipping and should be tested. A lack of any such transference of material from the drum (100) to the interior of the packaging (306) can be taken to mean that the drum (100) was most likely not subject to contact or potential damage during shipping.

Figure 8:
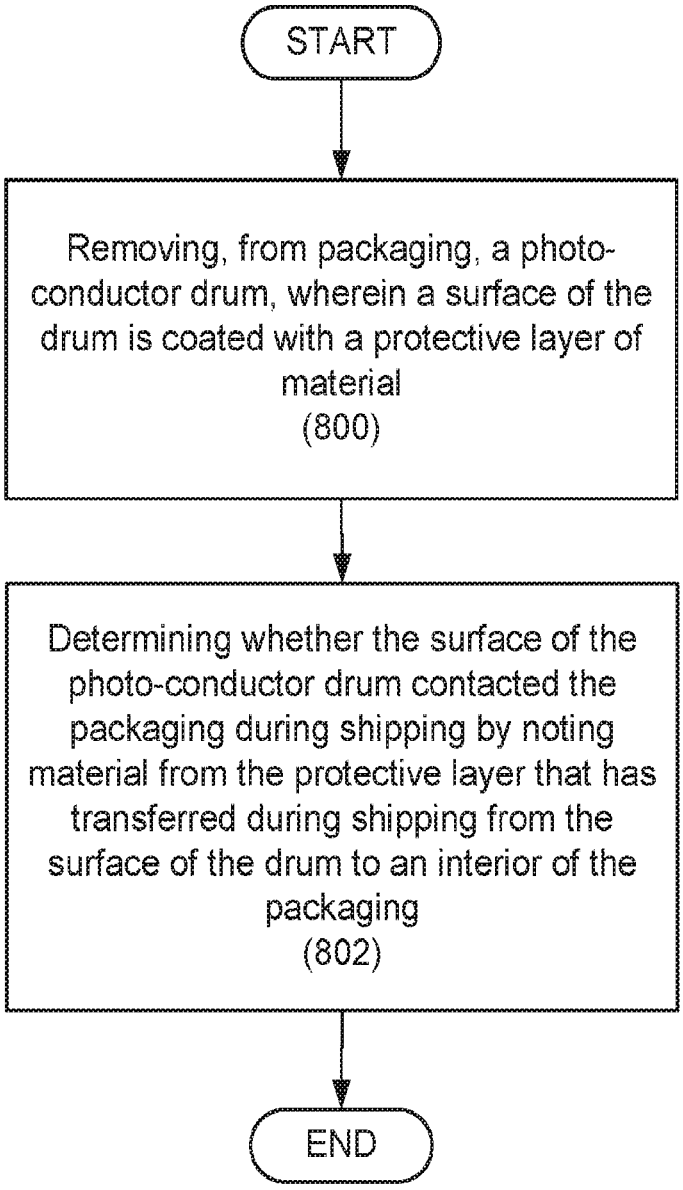
FIG. 8 is a flowchart of an example of a method of evaluating a photo-conductor drum after shipping, consistent with the disclosed implementations.

FIG. 8 is a flowchart of an example of a method of evaluating a photo-conductor drum after shipping, consistent with the disclosed implementations. As shown in FIG. 8, the method includes removing (800), from packaging, a photo-conductor drum, wherein a surface of the drum is coated with a protective layer of material; and determining (802) whether the surface of the photo-conductor drum contacted the packaging during shipping by noting material from the protective layer that has transferred during shipping from the surface of the drum to an interior of the packaging.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A photo-conductor drum cartridge comprising:

a photo-conductor drum having a cylindrical surface to receive a charge pattern corresponding to an image to be printed;

a cartridge structure in which the photo-conductor drum is incorporated; and a protective layer of charged toner coating at least an entire printable area of the cylindrical surface to protect the cylindrical surface from damage prior to installation of the drum in a printing device.

2. The photo-conductor drum of claim 1, wherein the protective layer comprises a warning image that comprises one of: text and an icon.

3. The photo-conductor drum of claim 1, wherein the protective layer coats the entire cylindrical surface.

4. A photo-conductor drum comprising:

a cylindrical surface to receive a charge pattern corresponding to an image to be printed;

a warning image of charged toner formed within a warning image region of the cylindrical surface to discourage contact with the surface; and a protective layer of charged toner coating at least a portion of the cylindrical surface outside the warning image region to protect the cylindrical surface from damage resulting from contact with the cylindrical surface prior to installation of the drum in a printing device.

5. The drum of claim 4, wherein the warning image comprises a warning not to touch the cylindrical surface of the drum, and wherein the warning comprises a textual warning.

6. The drum of claim 4, wherein the warning image comprises a warning not to touch the cylindrical surface of the drum, and wherein the warning comprises an icon.

7. A method comprising:

forming a photo-conductor drum with a cylindrical surface to receive a charge pattern corresponding to an image to be printed;

forming a protective layer of charged toner on at least an entire printable area of the cylindrical surface to protect the surface from damage; and packaging the photo-conductor drum with the protective layer for distribution to an end-user.

8. The method of claim 7, further comprising incorporating the drum into a replaceable cartridge structure for installation in a printing device.

9. The method of claim 7, wherein the protective layer comprises an image including a warning not to touch the cylindrical surface.

10. The method of claim 9, further comprising forming the image by:

forming a latent electrostatic image on the cylindrical surface; and developing the electrostatic image with toner.

11. The method of claim 9, further comprising forming the image using a stencil with toner being applied through the stencil to form the toner image.

12. The method of claim 9, wherein the warning comprises an icon.

13. The method of claim 7, further comprising covering all of a printable area of the cylindrical surface with the protective layer.

14. The method of claim 7, wherein the protective layer is formed on the entire cylindrical surface.

15. A method comprising:

forming a photo-conductor drum with a cylindrical surface to receive a charge pattern corresponding to a warning image to be printed;

forming a protective layer comprising toner on the cylindrical surface to protect the surface from damage by forming first a coating layer of toner on the cylindrical surface; and forming second an image layer on the coating layer, the image layer comprising the warning; and packaging the photo-conductor drum with the protective layer for distribution to an end-user.

16. A method comprising:

forming a uniform charge pattern on a cylindrical surface of a photo-conductor drum;

selectively dissipating the charge pattern in an image region of the cylindrical surface that corresponds to a warning image;

applying charged toner to the cylindrical surface to form the warning image in the image region and a protective layer in another region of the cylindrical surface to protect the surface from damage; and packaging the photo-conductor drum with the protective layer and the warning image for distribution to an end-user.

17. The method of claim 16, wherein the another region comprises the entire surface of the drum other than the image region.

18. The method of claim 16, wherein the another region comprises the entire printable area of the surface of the drum other than the image region.

* * * * *